United States Patent [19]

Rice et al.

[11] Patent Number: 4,923,104

[45] Date of Patent: May 8, 1990

[54] CHILD CARRIER AND PROTECTOR

[76] Inventors: Doris Rice; Kevin A. Rice, both of 7610 Thouron Ave., Philadelphia, Pa. 19150; Elvin T. Rice, 1921 Bonitz St., Philadelphia, Pa. 19140

[21] Appl. No.: 113,575

[22] Filed: Oct. 27, 1987

[51] Int. Cl.[5] ..... A47D 13/02

[52] U.S. Cl. ..... 224/155; 224/160; 2/69.5

[58] Field of Search ..... 224/155, 158, 159, 160, 224/156, 151, 161; 5/98 R, 98 B; 2/69.5, 84; 128/1 B

[56] References Cited

U.S. PATENT DOCUMENTS

| | | | |
|---|---|---|---|
| 2,264,314 | 12/1941 | Johns | 2/84 |
| 2,346,989 | 4/1944 | O'Brien | 224/155 |
| 2,554,340 | 5/1951 | Maxwell | 224/160 |
| 2,856,607 | 10/1958 | Richardson | 2/DIG. 5 |
| 3,096,917 | 7/1963 | Gudiksen | 5/98 R |
| 3,162,343 | 12/1964 | Anderson | 224/160 |
| 3,575,326 | 4/1971 | Chappell | 224/159 |
| 4,009,808 | 3/1977 | Sharp | 224/160 |
| 4,333,591 | 6/1982 | Case | 224/160 |
| 4,685,152 | 8/1987 | Heare | 2/84 |

FOREIGN PATENT DOCUMENTS

| | | | |
|---|---|---|---|
| 371110 | 5/1950 | Denmark | 224/159 |

*Primary Examiner*—Harvey C. Hornsby
*Assistant Examiner*—Joseph S. Machuga
*Attorney, Agent, or Firm*—Kenyon & Kenyon

[57] ABSTRACT

A combination carrier and protector for infants and small children, which is designed for maximum safety, comfort and versatility. The combination carrier and protector is adaptable to almost any means of transporting a child, including by automobile, by bicycle and by foot. The carrier is versatile—it is waterproof and warm in inclement weather, yet lightweight and cool for summertime use. The design also allows incidentals such as bottles, food, diapers, etc., to be transported with the child, and when the child outgrows the carrier, it becomes a doll carrier or a backpack.

7 Claims, 2 Drawing Sheets

CHILD CARRIER AND PROTECTOR

This invention pertains generally to a device to transport infants and small children in all types of weather, and more improved design of multifunctional device which facilitates the rapid, yet safe transportation of infants and small children through the use of removable multifunctional component parts.

BACKGROUND OF THE INVENTION

The child carriers and protectors presently available are generally devices with limited functions. Most so-called child carriers, such as that disclosed by Schimmels in U.S. Pat. No. 4,440,331 are basically infant seats for automobiles or bicycles. As such they are usually limited to constraining the infant and child by limiting its mobility. A few carriers such as that disclosed by Schimmels provide for some type of head or upper torso protection in event of an accident.

Generally, most presently available child carriers offer only limited protection from the environment. For example, Potts in U.S. Pat. No. 4,314,727 discloses a transparent, waterproof "bubble" which protects only the upper-half of an infant in an automobile seat from precipitation. In fact, most child protectors are useful only in warm weather. For example, Pap et al., U.S. Pat. No. 4,293,162, discloses a sunshade for an infant seat. Therefore, it is hoped that persons using the invention of Pap et al. do not travel into cold or wet climates.

Moreover, the present inventors are unaware of any device which is adapted to for the safe, weatherproof transportation of infants and small children when they are not constrained in or on a vehicle. There is believed to be a pressing need for an infant carrier which is not adapted for use in or on a vehicle and which provides the child with maximum comfort and support in all kinds of weather, while at the same time allowing for the child to be moved, hands-free, by an adult. Additionally, since most of the child carriers studied are made of rigid materials and are incapable of growing with the child, they have a built-in obsolescence; once the child outgrows the carrier, the carrier becomes an attic relic.

Therefore, it is an object of the present invention to provide for a child carrier which allows for the safe transport of infants and young children.

It is a further object of this invention to provide for the transport of an infant or young child, without the use of a vehicle, in a hands-free manner.

It is a further object of this invention to provide for child carrier which is able to accommodate children of a variety of sizes or ages.

It is a further object of this invention to provide for a child carrier which is inexpensive, yet durable.

It is still a further object of this invention to provide for a child carrier which accomplishes all of the above disclosed objects, yet has other uses once the child has outgrown the carrier.

These and other objects of the present invention will become more fully apparent with the following drawings and the description of the preferred embodiment.

SUMMARY OF INVENTION

According to the present invention, a child carrier and protector is provided which comprises a main body unit to which a means of seating and securing a child is provided on one face and a means of securing the unit to an adult is provided on the other face. The seating means is a piece of flexible material, the lower portion of which can be folded back and secured to the upper portion thereby forming a seat. In order to prevent the infant from falling from the seat, additional securing means are provided. For inclimate weather, the present invention provides for a water-proof protecting means to cover and insulate the torso and extremities of the infant. To further protect the infant from precipitation, the present invention provides for a clear, waterproof, ventilated hood.

DESCRIPTION OF A PREFERRED EMBODIMENT

Figure 2:
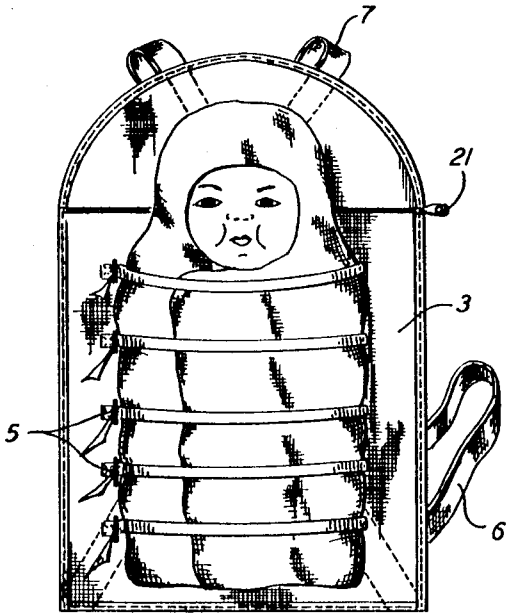
FIG. 2 is a pictorial view of the child protector and carrier with the front panel removed depicting an infant seated and secured therein.
Figure 1:
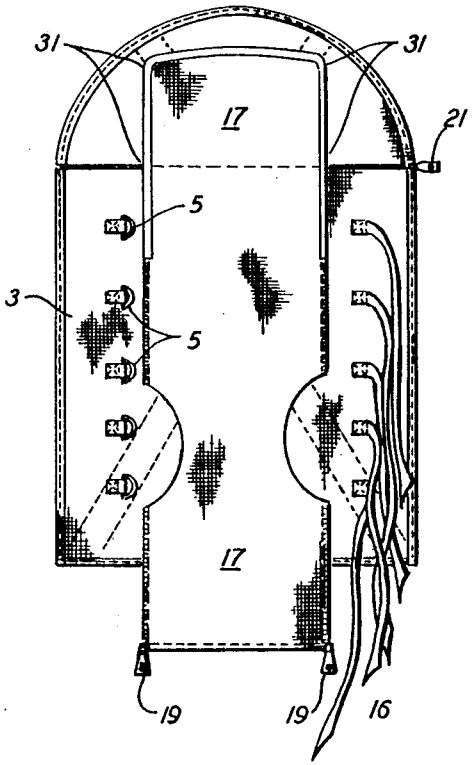
FIG. 1 is a perspective view of the child protector and carrier with the waterproof protecting means removed to show the infant seating and securing means.
Figure 4:
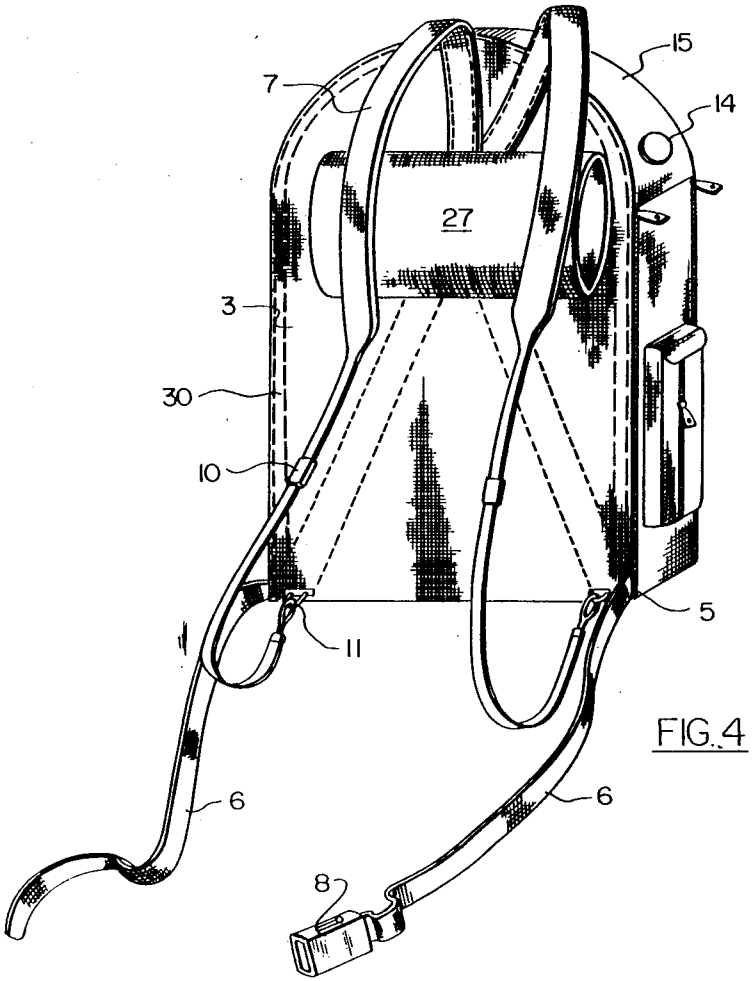
FIG. 4 is a rear view of the child protector and carrier showing the carrying means.

The present invention can be best described by providing and explaining the preferred embodiment. Referring to FIGS. 1, 2, and 4 the present invention is comprised of a main body unit (3). The only requirement for the main body unit is structural integrity. In one preferred embodiment structural integrity is provided by a lightweight metal structure (30) covered by a waterproof or water-resistant material such as 70-denier ripstop nylon or 70-denier Antron® fabric. Another suitable material is Caprolan® nylon Oxford cloth. Such fabrics provide comfort to both the infant and the adult and a high degree of durability. In an alternative preferred embodiment, the main body unit consists of heavy, durable fabric without a metallic superstructure. Quilted materials and 200-plus denier denims which have been waterproofed by well known means would be preferred.

As shown in FIG. 1, the preferred seating means is flexible, durable fabric (17) attached securely to the main body unit (3) at (31). The unattached portion of (17), once an infant is placed on it, is then folded upward and secured to the attached portion of (17) by a fastening means. While zippers (19) are the preferred fastening means, any type of commercial fasteners may be used. Because the material used to form the seating means is flexible, the seat can be adjusted to protect and carry both the very young, small infant and the average-sized toddler. Consequently, the usable life of the present invention as a child carrier and protector can be up to five or six years.

To secure the infant in the seating means provided by (17) and (19), the present invention provided for an additional securing means. While FIG. 1 depicts a securing means which consists of threading fiber belts through "D" rings, other securing means may be substituted. The securing means provided by the present invention allows for additional protection of the infant in cold weather. As shown in FIG. 2, the infant can be wrapped in blankets prior to securing to the child protector and carrier.

Figure 3:
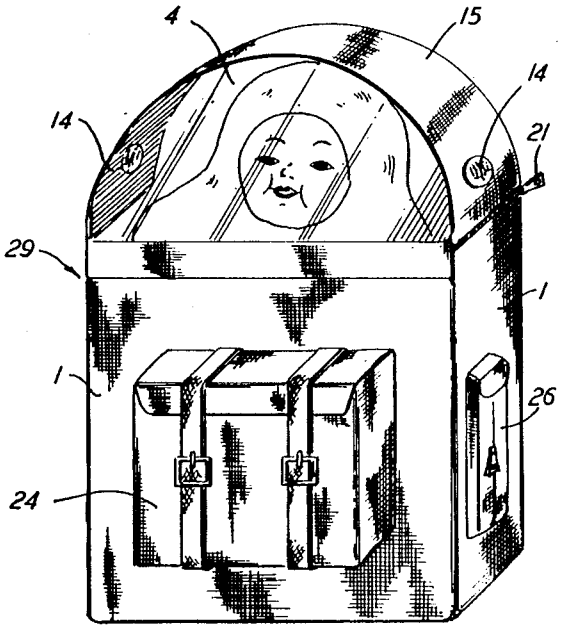
FIG. 3 is a front pictorial view of an infant in the child protector and carrier, with infant being seated, secured and fully protected from the environment.
Figure 5:
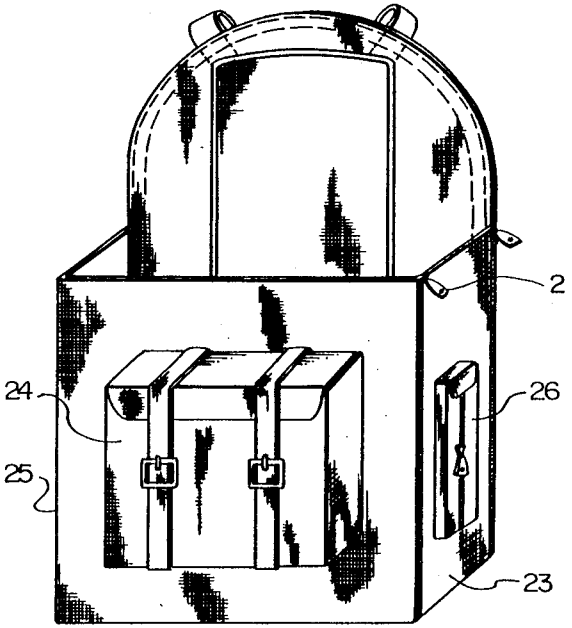
FIG. 5 is an alternative means for protecting the secured infant from the environment.

In inclimate weather, the present invention provides for a means for protecting the infant from the elements. As shown in FIG. 3, the present invention provides for a weatherproof panel (1) which can be attached to the main body. The panel may be the same waterproof fabric as the main body or it may be of a second material in order to provide additional structural integrity or asthetic enhancements to the carrier. In a preferred embodiment, the waterproof panel (1) is attached to the main body unit (3) by zipper (21). As shown in FIG. 3, various pockets, e.g., (24) and (26), can be provided in to increase the versatility of this versatile panel. If a protector with more structural integrity is desired, the one piece panel (1), can be replaced by two discrete panels (23) and (25) as provided in FIG. 5. These panels, (23) and (25), can be attached together by a zipper (2). The use of the waterproof panel, or the two discrete panels, allows the child carrier and protector to have a "second life" after the child outgrows it—the present invention can be used as a knapsack to carry other items after the infant has outgrown the child protector.

The present invention further provides for the protection of the head of the infant from wind and or precipitation by means of a hood (15) which attaches to the waterproof panel (1). While in a preferred embodiment the hood (15) which is of the same waterproof material as the main body unit (3), it too can be of a second or third material. For the comfort of the infant, the hood (15) can be provided with viewing panel (4) of a hard clear plastic such as Plexiglass® and the requisite air vents (14). The hood can be conveniently connected to the waterproof panel by means of a zipper (21).

The carrying means of the present invention approximates that used in conventional knapsacks. As depicted in FIG. 4, the preferred carrying means consists of shoulder straps (7), preferably padded, with adjustment buckles (10) which hook into fasteners (11) located on the main body unit (3). For added comfort an adjustable belt consisting of two fabric strips (6) extending from the main body unit (3) joined by a quick-release military buckle. Additionally, an armhole (27) is provided so that the present invention can be carried with one arm. In an embodiment of the present invention the fabric of the shoulder straps and the adjustable belt are the same as that used for the main body unit, while the buckles and fasteners are of a rust-proof material, preferably an unbreakable plastic.

While the foregoing description and drawings are primarily directed to the preferred embodiment, it is apparent that various changes may be made in the form, size, construction and arrangement of the components of the invention without departing from the spirit and scope thereof or sacrificing the advantages provided. Consequently, the arrangement of the invention hereinbefore described is merely by way of example and the invention is not to be restricted to the specific form shown or usages mentioned, except as defined in the accompanying claims.

What is claimed is:

1. A device adapted for the transport and protection of an infant or small child having a main body unit, a means for seating said infant or small child which is adjustable so as to accommodate children or infants of various sizes comprising a piece of flexible material, the upper portion of said flexible material being secured to the main body unit and the lower portion of said flexible material adapted, once said infant or small child is placed upon said flexible material, to fold upward and attach to the said upper portion, a means for securing said infant in said seating means, a means for protecting said infant from inclement weather comprising a waterproof panel which may be secured to said main body units and a hood secured to said waterproof panel, said hood comprises a hard, rigid, transparent viewing panel and air vents, and a means for carrying said main body unit; said means for seating and said means for securing being attached to one face of said main body unit, and said means for carrying being attached to the opposite face of said main body unit.

2. The device as in claim 1, wherein said hood is secured to said waterproof panel by a zipper means.

3. The device as in claim 1, wherein said carrying means comprises adjustable shoulder straps secured to said main body unit.

4. The device as in claim 1, wherein said main body unit comprises a lightweight metal frame covered by a waterproof or water-resistant material.

5. The device as in claim 4, wherein said waterproof or water-resistant material is 70-denier ripstop nylon.

6. The device as in claim 1, wherein said main body unit consists of a heavy durable fabric.

7. The claim as in claim 1, wherein said carrying means comprises an arm hole secured to said main body unit.

* * * * *